US006578534B2

(12) United States Patent
Nohara et al.

(10) Patent No.: US 6,578,534 B2
(45) Date of Patent: Jun. 17, 2003

(54) VARIABLE VALVE OPERATING SYSTEM OF INTERNAL COMBUSTION ENGINE ENABLING VARIATION OF VALVE-LIFT CHARACTERISTIC

(75) Inventors: Tsuneyasu Nohara, Kanagawa (JP); Takanobu Sugiyama, Yokohama (JP); Shinichi Takemura, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/228,988

(22) Filed: Aug. 28, 2002

(65) Prior Publication Data

US 2003/0062009 A1 Apr. 3, 2003

(30) Foreign Application Priority Data

Oct. 3, 2001 (JP) ..... 2001-307031

(51) Int. Cl.[7] ..... F01L 1/34

(52) U.S. Cl. ..... 123/90.16; 123/90.17; 123/90.15

(58) Field of Search ..... 123/90.15–90.18, 123/90.31, 90.6; 74/568 R

(56) References Cited

U.S. PATENT DOCUMENTS 5,636,603 A 6/1997 Nakamura et al.

5,992,361 A * 11/1999 Murata et al. ..... 123/90.17

FOREIGN PATENT DOCUMENTS

JP 8-260923 10/1996

* cited by examiner

*Primary Examiner*—Thomas Denion
*Assistant Examiner*—Kyle Riddle
(74) *Attorney, Agent, or Firm*—Foley & Lardner

(57) ABSTRACT

In an engine employing a variable lift and working angle control mechanism enabling both a valve lift and a working angle of an intake valve to be continuously simultaneously varied depending on engine operating conditions, the control mechanism includes at least a rocker arm and a control shaft formed integral with an eccentric cam. The valve lift characteristic of the control mechanism varies by changing an angular position of the control shaft. A control-shaft position sensor has a directivity for the sensor output error occurring owing to a change in relative position between the control shaft center and the position sensor. The error becomes a minimum value in a specified direction of relative position change. The specified direction of relative position change is set to be substantially identical to a direction of a line of action of load acting on the center of the control shaft during idling.

11 Claims, 10 Drawing Sheets

VARIABLE VALVE OPERATING SYSTEM OF INTERNAL COMBUSTION ENGINE ENABLING VARIATION OF VALVE-LIFT CHARACTERISTIC

TECHNICAL FIELD

The present invention relates to a variable valve operating system of an internal combustion engine enabling valve-lift characteristic (valve lift and event) to be varied, and in particular being capable of continuously simultaneously changing all of valve lift and working angle of an intake valve depending on engine operating conditions.

BACKGROUND ART

There have been proposed and developed various internal combustion engines equipped with a variable valve operating system enabling valve-lift characteristic (valve lift and working angle) to be continuously varied depending on engine operating conditions, in order to reconcile both improved fuel economy and enhanced engine performance through all engine operating conditions. One such variable valve operating system has been disclosed in Japanese Patent Provisional Publication No. 8-260923 (corresponding to U.S. Pat. No. 5,636,603 issued Jun. 10, 1997 to Makoto Nakamura et al.). The variable valve operating system disclosed in U.S. Pat. No. 5,636,603 is comprised of a variable working angle control mechanism capable of variably continuously controlling a working angle of an intake valve depending on engine operating conditions. The variable valve operating system disclosed in U.S. Pat. No. 5,636,603 is comprised of a drive shaft, a control shaft, an annular disc (or an intermediate member), and a cam. The drive shaft is rotatably supported on an engine body in such a manner as to rotate in synchronism with rotation of the engine crankshaft. The control shaft is also rotatably supported on the engine body so that an angular position of the control shaft is variably controlled by means of a hydraulic actuator. The annular disc is mechanically linked to the drive shaft, so that rotary motion of the drive shaft is transmitted via a pin to the annular disc. The central position of rotary motion of the annular disc displaces or shifts relative to the engine body depending on a change in the angular position of the control shaft. The cam rotates in synchronism with rotary motion of the annular disc to open and close an intake valve. Changing the center of rotary motion of the annular disc causes ununiform rotary motion of the annular disc itself, consequently ununiform rotary motion of the cam, and thus an intake valve open timing (IVO), an intake valve closure timing (IVC), and a working angle (a lifted period) of the intake valve vary. The system disclosed in U.S. Pat. No. 5,636,603 has a control-shaft position sensor or a control-shaft rotation angle sensor that detects an actual angular position of the control shaft and generates a sensor signal indicative of the actual angular position of the control shaft. A potentiometer is used as such a position sensor. The previously-noted hydraulic actuator is closed-loop controlled based on the sensor signal output from the position sensor, so that the actual angular position of the control shaft is brought closer to a desired angular position based on the engine operating conditions.

SUMMARY OF THE INVENTION

In the variable valve operating system of U.S. Pat. No. 5,636,603, the control-shaft position sensor (potentiometer) is attached onto or directly coupled with the control shaft end. Directly coupling the control-shaft position sensor to the control shaft end, permits vibrations and loads input into the control shaft to be transferred therefrom directly into the control-shaft position sensor. This reduces the durability of the control-shaft position sensor. Actually, the control shaft receives various loads due to a valve-spring reaction force and inertia forces of moving parts. During input-load application to the control shaft, a change in relative position between the axis of the control shaft and the axis of the control-shaft position sensor occurs owing to a radial displacement of the control shaft within a clearance of a control-shaft bearing whose outer race is fitted to the engine body. As appreciated, the relative-position change exerts a bad influence on the durability of the control-shaft position sensor. To avoid this, the control shaft end and the control-shaft position sensor may be coupled with each other by means of a coupling mechanism that permits a change in relative position between the control shaft end and the control-shaft position sensor. In lieu thereof, a non-contact position sensor such as an electromagnetic rotation angle sensor, may be used to detect the actual angular position of the control shaft. However, suppose that the coupling mechanism is merely disposed between the control shaft end and the control-shaft position sensor without deliberation or the non-contact position sensor is used in a manner so as to permit the relative-position change. There is a problem of a great error contained in the position sensor signal output owing to such a relative-position change. The great error reduces the detection accuracy of the control-shaft position sensor. Therefore, it is desirable to effectively suppress the detection accuracy of the control-shaft position sensor from being reduced due to a change in relative position between the control shaft end and the control-shaft position sensor, which may occur owing to input load applied to the control shaft, while permitting the relative-position change.

Accordingly, it is an object of the invention to provide a variable valve operating system of an internal combustion engine enabling valve-lift characteristic to be continuously varied, which avoids the aforementioned disadvantages.

In order to accomplish the aforementioned and other objects of the present invention, a variable valve operating system of an internal combustion engine comprises a drive shaft adapted to be rotatably supported on an engine body and to rotate about an axis in synchronism with rotation of a crankshaft of the engine, a control shaft adapted to be rotatably supported on the engine body, an actuator driving the control shaft to adjust an angular position of the control shaft, an intermediate member that rotary motion of the drive shaft is converted into either of rotary motion and oscillating motion of the intermediate member, a center of the motion of the intermediate member with respect to the engine body varying depending on the angular position of the control shaft, the intermediate member linked to an intake valve of the engine, for lifting the intake valve responsively to the motion of the intermediate member, a valve lift characteristic of the intake valve being varied depending on a change in the center of the motion of the intermediate member, a position sensor attached to the engine body to generate a sensor signal indicative of the angular position of the control shaft, the position sensor having a directivity for an error contained in the sensor signal owing to a change in relative position between a center of the control shaft and the position sensor, the error becoming a minimum value in a specified direction of the relative position change, and the specified direction of the relative position change being set to be substantially identical to a direction of a line of action of load acting on the center of the control shaft during idling.

According to another aspect of the invention, a variable valve operating system of an internal combustion engine comprises a drive shaft adapted to be rotatably supported on an engine body and to rotate about an axis in synchronism with rotation of a crankshaft of the engine, the drive shaft having a first eccentric cam fixedly connected to an outer periphery of the drive shaft, a link arm rotatably fitted onto an outer periphery of the first eccentric cam, a control shaft adapted to be rotatably supported on the engine body, the control shaft formed integral with a second eccentric cam, an actuator driving the control shaft to adjust an angular position of the control shaft, a rocker arm rotatably supported on an outer periphery of the second eccentric cam so that the oscillating motion of the rocker arm is created by the link arm, a rockable cam rotatably fitted on the outer periphery of the drive shaft, a link member mechanically linking the rocker arm to the rockable cam so that the oscillating motion of the rocker arm is converted into an oscillating motion of the rockable cam and that the intake valve is pushed by the oscillating motion of the rockable cam, a valve lift and a working angle of the intake valve simultaneously varying by changing an angular position of the second eccentric cam of the control shaft, a position sensor attached to the engine body to generate a sensor signal indicative of the angular position of the control shaft, the position sensor having a directivity for an error contained in the sensor signal owing to a change in relative position between a center of the control shaft and the position sensor, the error becoming a minimum value in a specified direction of the relative position change, and the specified direction of the relative position change being set to be substantially identical to a direction of a line segment interconnecting a center of the drive shaft and the center of the control shaft, during idling.

According to a further aspect of the invention, an internal combustion engine comprises a variable lift and working angle control mechanism that enables both a valve lift and a working angle of an intake valve to be continuously simultaneously varied depending on engine operating conditions, the variable lift and working angle control mechanism comprising a drive shaft adapted to be rotatably supported on an engine body and to rotate about an axis in synchronism with rotation of a crankshaft of the engine, a control shaft adapted to be rotatably supported on the engine body, an actuator driving the control shaft to adjust an angular position of the control shaft, and an intermediate member through which rotary motion of the drive shaft is converted into either of rotary motion and oscillating motion of the intermediate member, a center of the motion of the intermediate member with respect to the engine body varying depending on the angular position of the control shaft, the intermediate member linked to the intake valve, for lifting the intake valve responsively to the motion of the intermediate member, and a valve lift characteristic including both the valve lift and the working angle of the intake valve being varied depending on a change in the center of the motion of the intermediate member, sensor means attached to the engine body for generating a sensor signal indicative of the angular position of the control shaft, the sensor means having a directivity for an error contained in the sensor signal owing to a change in relative position between a center of the control shaft and the sensor means, the error becoming a minimum value in a specified direction of the relative position change, and the specified direction of the relative position change being set to be substantially identical to a direction of a line of action of load acting on the center of the control shaft during idling.

The other objects and features of this invention will become understood from the following description with reference to the accompanying drawings.

DESCRIPTION OF THE PREFERRED EMBODIMENTS

Figure 1:
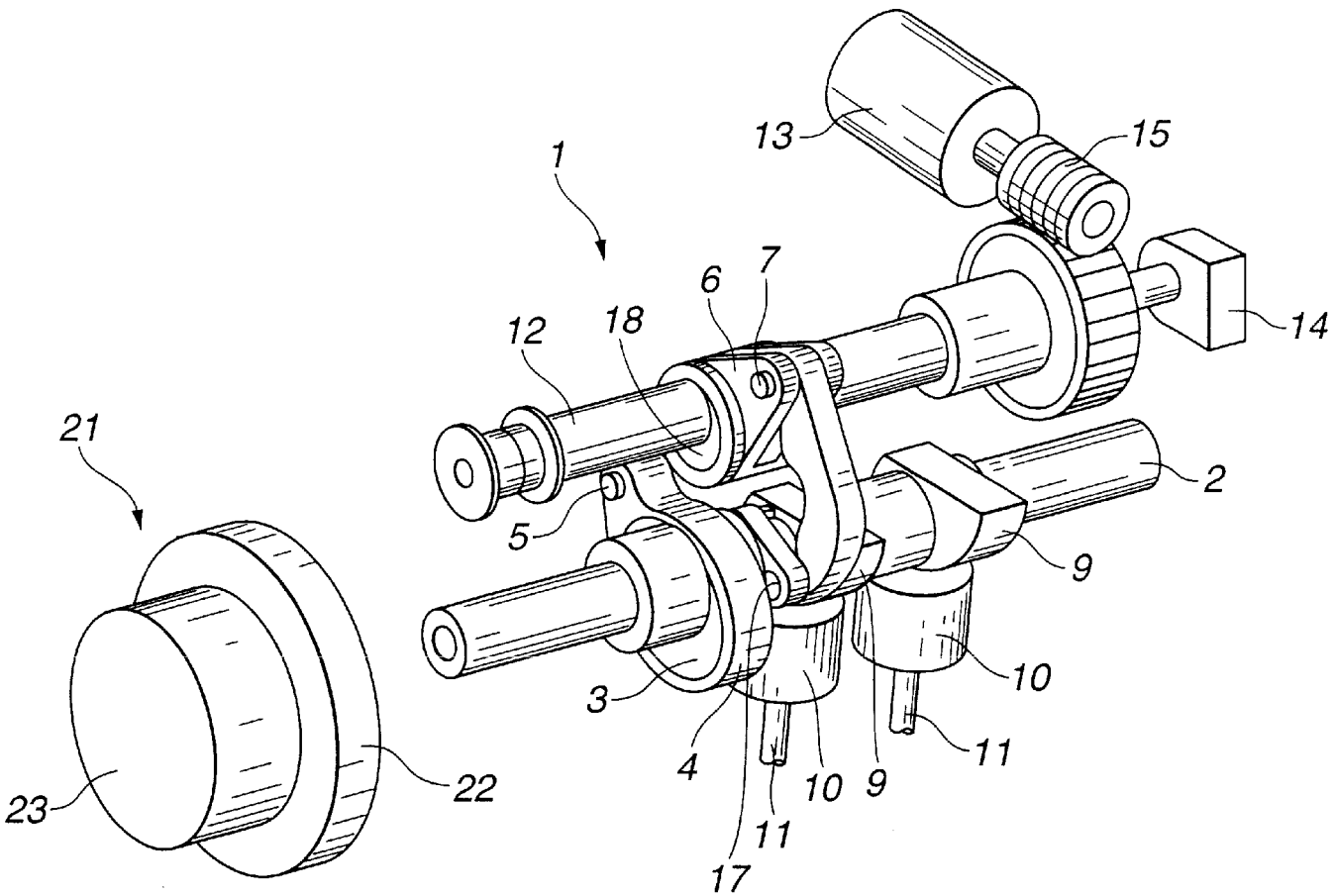
FIG. 1 is a perspective view illustrating a variable valve operating system employing both a variable lift and working angle control mechanism and a variable phase control mechanism.

Referring now to the drawings, particularly to FIG. 1, the variable valve operating system of the invention is exemplified in an automotive spark-ignition four-cylinder gasoline engine. In the embodiment shown in FIG. 1, the variable valve operating system is applied to an intake-port valve of engine valves. As shown in FIG. 1, the variable valve operating system of the embodiment is constructed to include both a variable lift and working angle control mechanism (or a variable valve-lift characteristic mechanism) 1 and a variable phase control mechanism 21 combined to each other. In lieu thereof, the variable valve operating system of the embodiment may be constructed to include only the variable lift and working angle control mechanism 1. Variable lift and working angle control mechanism 1 enables the valve-lift characteristic (both the valve lift and working angle of the intake valve) to be continuously simultaneously varied depending on engine operating conditions. On the other hand, variable phase control mechanism 21 enables the phase of working angle (an angular phase at the maximum valve lift point often called "central angle") to be advanced or retarded depending on the engine operating conditions. Variable lift and working angle control mechanism 1 incorporated in the variable valve operating system of the embodiment is similar to a variable valve actuation apparatus such as disclosed in U.S. Pat. No. 5,988,125 (corresponding to JP11-107725), issued Nov. 23, 1999 to Hara et al, the teachings of which are hereby incorporated by reference. The construction of variable lift and working angle control mechanism 1 is briefly described hereunder. Variable lift and working angle control mechanism 1 is comprised of an intake valve 11 slidably supported on a cylinder head (not shown), a drive shaft 2, a first eccentric cam 3, a control shaft 12, a second eccentric cam 18, a rocker arm 6, a rockable cam 9, a link arm 4, and a link member 8. Drive shaft 2 is rotatably supported by a cam bracket (not shown), which is located on the upper portion of the cylinder head. First eccentric cam 3 is fixedly connected to the outer periphery of drive shaft 2 by way of press-fitting. Control shaft 12 is rotatably supported by the same cam bracket through a control-shaft bearing (not shown) whose outer race is fitted to the engine body such as a cylinder head. Control shaft 12 is located parallel to drive shaft 2. Second eccentric cam 18 is fixedly connected to or integrally formed with control shaft 12. Rocker arm 6 is rockably supported on the outer periphery of second eccentric cam 18 of control shaft 12. Rockable cam 9 is rotatably fitted on the outer periphery of drive shaft 2 in such a manner as to directly push an intake-valve tappet 10, which has a cylindrical bore closed at its upper end and provided at the valve stem end of intake valve 11. Link arm 4 serves to mechanically link first eccentric cam 3 to rocker arm 6. On the other hand, link member 8 serves to mechanically link rocker arm 6 to rockable cam 9. Drive shaft 2 is driven by an engine crankshaft (not shown) via a timing chain or a timing belt, such that drive shaft 2 rotates about its axis in synchronism with rotation of the crankshaft. First eccentric cam 3 is cylindrical in shape. The central axis of the cylindrical outer peripheral surface of first eccentric cam 3 is eccentric to the axis of drive shaft 2 by a predetermined eccentricity. A substantially annular portion of link arm 4 is rotatably fitted onto the cylindrical outer peripheral surface of first eccentric cam 3. Rocker arm 6 is oscillatingly supported at its substantially annular central portion by second eccentric cam 18 of control shaft 12. A protruded portion of link arm 4 is linked to one end of rocker arm 6 by means of a first connecting pin 5. The upper end of link member 8 is linked to the other end of rocker arm 6 by means of a second connecting pin 7. The axis of second eccentric cam 18 is eccentric to the axis of control shaft 12, and therefore the center of oscillating motion of rocker arm 6 can be varied by changing the angular position of control shaft 12. Rockable cam 9 is rotatably fitted onto the outer periphery of drive shaft 2. One end portion of rockable cam 9 is linked to link member 8 by means of a third connecting pin 17. With the linkage structure discussed above, rotary motion of drive shaft 2 is converted into oscillating motion of rockable cam 9. Rockable cam 9 is formed on its lower surface with a base-circle surface portion being concentric to drive shaft 2 and a moderately-curved cam surface being continuous with the base-circle surface portion and extending toward the other end of rockable cam 9. The base-circle surface portion and the cam surface portion of rockable cam 9 are designed to be brought into abutted-contact (sliding-contact) with a designated point or a designated position of the upper surface of the associated intake-valve tappet 10, depending on an angular position of rockable cam 9 oscillating. That is, the base-circle surface portion functions as a base-circle section within which a valve lift is zero. A predetermined angular range of the cam surface portion being continuous with the base-circle surface portion functions as a ramp section. A predetermined angular range of a cam nose portion of the cam surface portion that is continuous with the ramp section, functions as a lift section. As clearly shown in FIG. 1, control shaft 12 of variable lift and working angle control mechanism 1 is driven within a predetermined angular range by means of a lift and working angle control actuator 13. In the shown embodiment, lift and working angle control actuator 13 is comprised of a geared servomotor equipped with a worm gear 15 and a worm wheel (not numbered) that is fixedly connected to control shaft 12. The servomotor of lift and working angle control actuator 13 is electronically controlled in response to a control signal from an electronic engine control unit often abbreviated to "ECU" (not shown). In the system of the embodiment, the rotation angle or angular position of control shaft 12, that is, the actual control state of variable lift and working angle control mechanism 1 is detected by means of a control-shaft position sensor 14. Lift and working angle control actuator 13 is closed-loop controlled or feedback-controlled based on the actual control state of variable lift and working angle control mechanism 1, detected by control-shaft position sensor 14, and a comparison with the desired value (the desired output). Variable lift and working angle control mechanism 1 operates as follows.

During rotation of drive shaft 2, link arm 4 moves up and down by virtue of cam action of first eccentric cam 3. The up-and-down motion of link arm 4 causes oscillating motion of rocker arm 6. The oscillating motion of rocker arm 6 is transmitted via link member 8 to rockable cam 9, and thus rockable cam 9 oscillates. By virtue of cam action of rockable cam 9 oscillating, intake-valve tappet 10 is pushed and therefore intake valve 11 lifts. If the angular position of control shaft 12 is varied by means of actuator 13, an initial position of rocker arm 6 varies and as a result an initial position (or a starting point) of the oscillating motion of rockable cam 9 varies. Assuming that the angular position of second eccentric cam 18 is shifted from a first angular position that the axis of second eccentric cam 18 is located just under the axis of control shaft 12 to a second angular position that the axis of second eccentric cam 18 is located just above the axis of control shaft 12, as a whole rocker arm 6 shifts upwards. As a result, the initial position (the starting point) of rockable cam 9 is displaced or shifted so that the rockable cam itself is inclined in a direction that the cam surface portion of rockable cam 9 moves apart from intake-valve tappet 10. With rocker arm 6 shifted upwards, when rockable cam 9 oscillates during rotation of drive shaft 2, the base-circle surface portion is held in contact with intake-valve tappet 10 for a comparatively long time period. In other words, a time period within which the cam surface portion is held in contact with intake-valve tappet 10 becomes short. As a consequence, a valve lift becomes small. Additionally, a lifted period (i.e., a working angle) from intake-valve open timing IVO to intake-valve closure timing IVC becomes reduced.

Conversely when the angular position of second eccentric cam 18 is shifted from the second angular position that the axis of second eccentric cam 18 is located just above the axis of control shaft 12 to the first angular position that the axis of second eccentric cam 18 is located just under the axis of control shaft 12, as a whole rocker arm 6 shifts downwards. As a result, the initial position (the starting point) of rockable cam 9 is displaced or shifted so that the rockable cam itself is inclined in a direction that the cam surface portion of rockable cam 9 moves towards intake-valve tappet 10. With rocker arm 6 shifted downwards, when rockable cam 9 oscillates during rotation of drive shaft 2, a portion that is brought into contact with intake-valve tappet 10 is somewhat shifted from the base-circle surface portion to the cam surface portion. As a consequence, a valve lift becomes large. Additionally, a lifted period (i.e., a working angle) from intake-valve open timing IVO to intake-valve closure timing IVC becomes extended. The angular position of second eccentric cam 18 can be continuously varied within predetermined limits by means of actuator 13, and thus valve lift characteristics (valve lift and working angle) also vary continuously, so that variable lift and working angle control mechanism 1 can scale up and down both the valve lift and the working angle continuously simultaneously. For instance, at full throttle and low speed, at full throttle and middle speed, and at full throttle and high speed, in the variable lift and working angle control mechanism 1 incorporated in the variable valve operating system of the embodiment, intake-valve open timing IVO and intake-valve closure timing IVC vary symmetrically with each other, in accordance with a change in valve lift and a change in working angle.

Referring again to FIG. 1, there is shown one example of variable phase control mechanism 21. In the shown embodiment, variable phase control mechanism 21 includes a sprocket 22 located at the front end of drive shaft 2, and a phase control actuator 23 that enables relative rotation of drive shaft 2 to sprocket 22 within predetermined limits. For power transmission from the crankshaft to the intake-valve drive shaft, a timing belt (not shown) or a timing chain (not shown) is wrapped around sprocket 22 and a crank pulley (not shown) fixedly connected to one end of the crankshaft. The timing belt drive or timing-chain drive permits intake-valve drive shaft 2 to rotate in synchronism with rotation of the crankshaft. A hydraulically-operated rotary type actuator or an electromagnetically-operated rotary type actuator is generally used as a phase control actuator that variably continuously changes a phase of central angle of the working angle of intake valve 11. Phase control actuator 23 is electronically controlled in response to a control signal from the electronic control unit. The relative rotation of drive shaft 2 to sprocket 22 in one rotational direction results in a phase advance at the maximum intake-valve lift point (at the central angle). Conversely, the relative rotation of drive shaft 2 to sprocket 22 in the opposite rotational direction results in a phase retard at the maximum intake-valve lift point. Only the phase of working angle (i.e., the angular phase at the central angle) is advanced or retarded, with no valve-lift change and no working-angle change. The relative angular position of drive shaft 2 to sprocket 22 can be continuously varied within predetermined limits by means of phase control actuator 23, and thus the angular phase at the central angle also varies continuously. In the system of the embodiment, the relative angular position of drive shaft 2 to sprocket 22 or the relative phase of drive shaft 2 to the crankshaft, that is, the actual control state of variable phase control mechanism 21 is detected by means of a drive shaft sensor (not shown). Phase control actuator 23 is closed-loop controlled or feedback-controlled based on the actual control state of variable phase control mechanism 21, detected by the drive shaft sensor (not shown), and a comparison with the desired value (the desired output).

In the internal combustion engine of the embodiment employing the previously-discussed variable valve operating system at the intake valve side, it is possible to properly control the amount of air drawn into the engine by variably adjusting the valve operating characteristics for intake valve 11, independent of throttle opening control.

Figure 2:
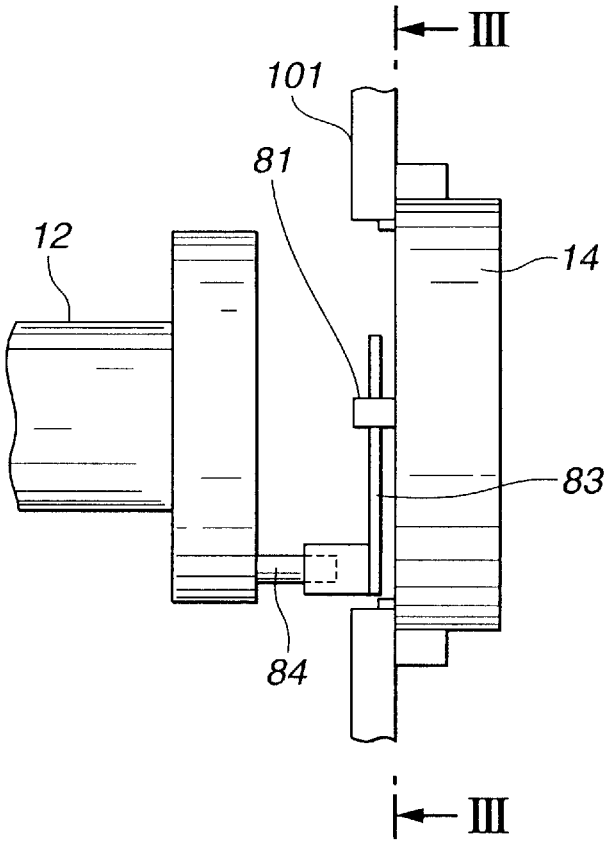
FIG. 2 is a side view illustrating one embodiment of a control-shaft position sensor that is applicable to the variable valve operating system according to the invention.
Figure 3:
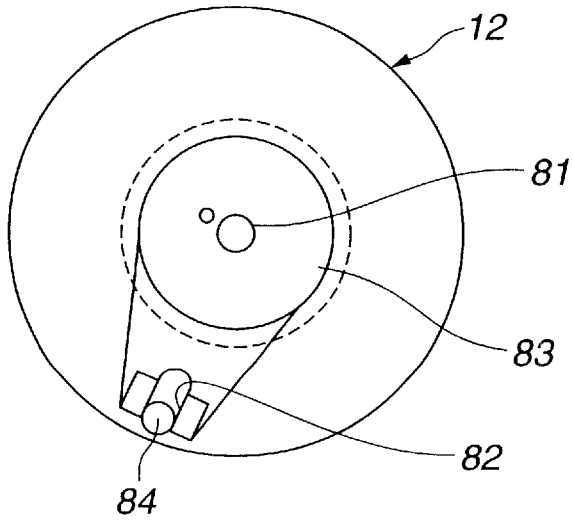
FIG. 3 is across section taken along the line III—III of FIG. 2.
Figure 4:
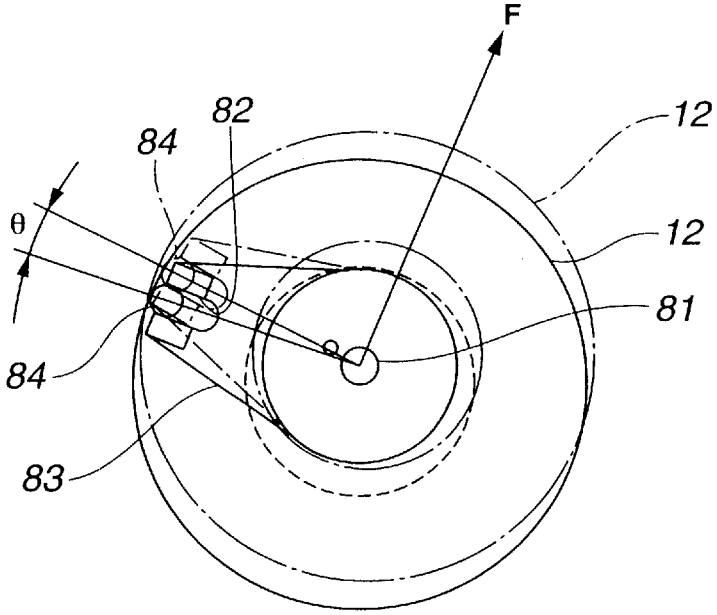
FIG. 4 is an explanatory view showing the relationship between the direction of load applied to a control shaft and a control-shaft position sensor's output error.
Figure 5:
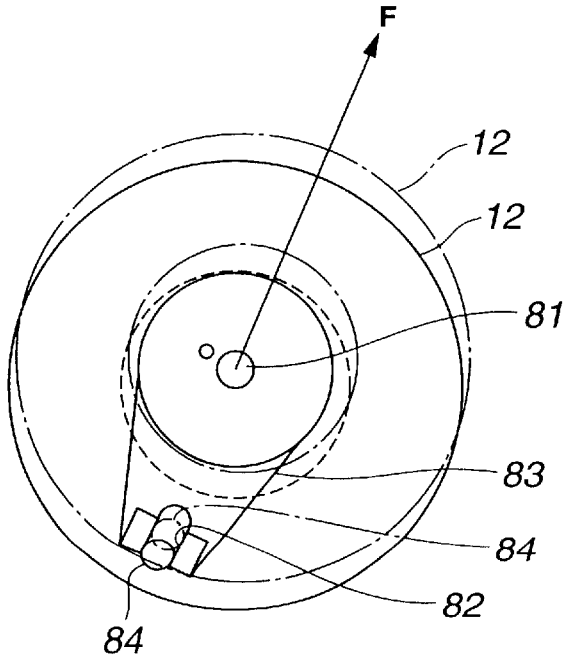
FIG. 5 is an explanatory view showing a direction of load in which the control-shaft sensor's output error is a minimum value.

Referring now to FIGS. 2 and 3, there is shown the detailed structure of control-shaft position sensor 14 of the first embodiment. Control-shaft position sensor 14 of FIGS. 2 and 3 is comprised of a rotary-motion-type potentiometer (or a rotary-motion-type variable resistor) that generates a sensor signal representative of an angular position of a sensor shaft 81. Control-shaft position sensor 14 is fixed or attached to a portion of a cylinder head denoted by reference sign 101, so that sensor shaft 81 is coaxially arranged with the axis of control shaft 12 under a particular condition that the engine is stopped. In order to permit a misalignment between the axis of sensor shaft 81 and the axis of control shaft 12 (in other words, a relative displacement of control shaft 12 to control-shaft position sensor 14) during operation of the engine, sensor shaft 81 is not directly coupled to the control shaft end. A pin 84 is fixedly connected to the end surface of control shaft 12 so that the axis of pin 84 is eccentric to the axis of control shaft 12. A radially-elongated slit 82 is formed in a base plate 83. Base plate 83 is fixedly connected to sensor shaft 81. Pin 84 is engaged with slit 82 so that rotary motion of control shaft 12 is transferred into sensor shaft 81 by way of such a pin-slit coupling mechanism (84, 82). With the previously-discussed control-shaft position sensor system employing the position sensor 14 and pin-slit coupling mechanism (84, 82), a change in relative position between the axis of control shaft 12 and the axis of control-shaft position sensor 14 takes place owing to a radial displacement of control shaft 12 within a bearing clearance of the control-shaft bearing. Owing to the change in relative position, that is, misalignment between control shaft 12 and control-shaft position sensor 14, as a matter of course, an error component is contained in the sensor signal from control-shaft position sensor 14. The magnitude of the error contained in the sensor signal output is determined depending on the interrelation between the direction of load F acting on control shaft 12 and the installation position of pin-slit coupling mechanism (84, 82), that is, the direction of the centerline of radially-elongated slit 82. The magnitude of the error contained in the sensor signal is hereinafter described in detail in reference to the explanatory views of FIGS. 4 and 5. As shown in FIG. 4, assuming that the installation position of pin-slit coupling mechanism (84, 82) is designed to be substantially perpendicular to the direction of load F applied to control shaft 12, base plate 83 tends to rotate by an angle θ in the clockwise direction (viewing FIG. 4) due to the applied load F. In this case, a comparatively great sensor output error occurs. In contrast to the above, as shown in FIG. 5, assuming that the installation position of pin-slit coupling mechanism (84, 82) is designed to be aligned with the direction of load F applied to control shaft 12, base plate 83 never rotates. In this case, the misalignment between the axis of control shaft 12 and the axis of control-shaft position sensor 14, occurring due to the applied load F, is absorbed by radially-inward sliding motion of pin 84 within slit 82. Therefore, the magnitude of the error contained in the sensor signal from control-shaft position sensor 14 becomes a minimum value. As explained above, in case of pin-slit coupling mechanism (84, 82), when a change in relative position between the axis of control shaft 12 and the axis of control-shaft position sensor 14, which may occur owing to the load applied to control shaft 12, takes place in such a manner as to be identical to the direction of the centerline of radially elongated slit 82, the magnitude of the error contained in the sensor signal from controls-shaft position sensor 14 becomes minimum. That is, control-shaft position sensor 14 has a directivity for the sensor output error. A load that lifts intake valve 11 against the valve-spring bias acts on control shaft 12, and additionally an inertia load that is created by moving parts, such as rocker arm 6 and link members acts on control shaft 12. A resultant force of these loads, namely, the valve-spring reaction force and the inertia load is applied to control shaft 12. The magnitude and the sense of the resultant force vary depending on the valve lift of intake valve 11 and engine speeds. In addition to the above, the direction of the centerline of slit 82 varies depending on the angular position of control shaft 12, in otherwords, engine/vehicle operating conditions. Therefore, it is impossible to always match the direction of the line of action of load acting on control shaft 12 to the direction of the centerline of slit 82 during operation of the engine. For the reasons set forth above, the control-shaft position sensor equipped variable valve operating system of the embodiment is constructed so that the direction of load applied to control shaft 12 becomes identical to the direction of the centerline of slit 82 during idling at which a highest control accuracy for variable lift and working angle control is required.

Figure 6:
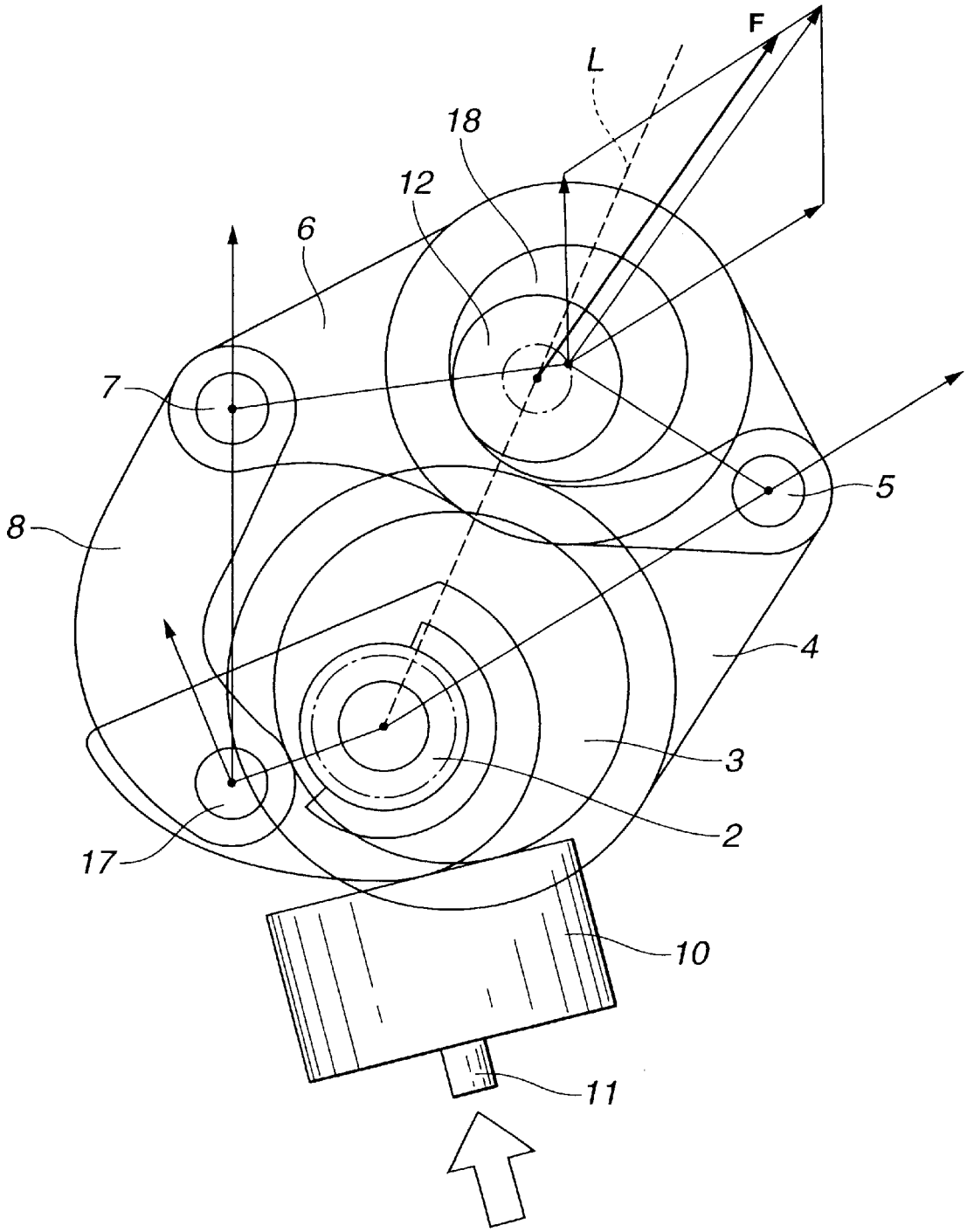
FIG. 6 is an explanatory view showing a direction of load F acting on the control shaft at a maximum valve lift point during idling.

Referring now to FIG. 6, there is shown the direction of geometrical load F created by valve-spring reaction force acting on control shaft 12, when the lift of intake valve 11 reaches a maximum valve lift during a valve-lift characteristic mode used during idling at which the valve lift of intake valve 11 is adjusted to a very small lift amount and the working angle is also adjusted to a very small working angle. With the engine at an idle rpm, there is a very small inertia load acting on control shaft 12. Most of the applied load F acting on control shaft 12 is based on the valve-spring reaction force. Thus, in the variable valve operating system of the embodiment, the installation angle of base plate 83 is optimally set so that the direction of load F acting on control shaft 12 is identical to the direction of the centerline of slit 82 in the control state used during idling, that is, in the previously-noted valve-lift characteristic mode used during idling. By way of optimal setting of the installation angle of base plate 83, it is possible to minimize the magnitude of the error contained in the sensor signal from control-shaft position sensor 14.

Figure 7:
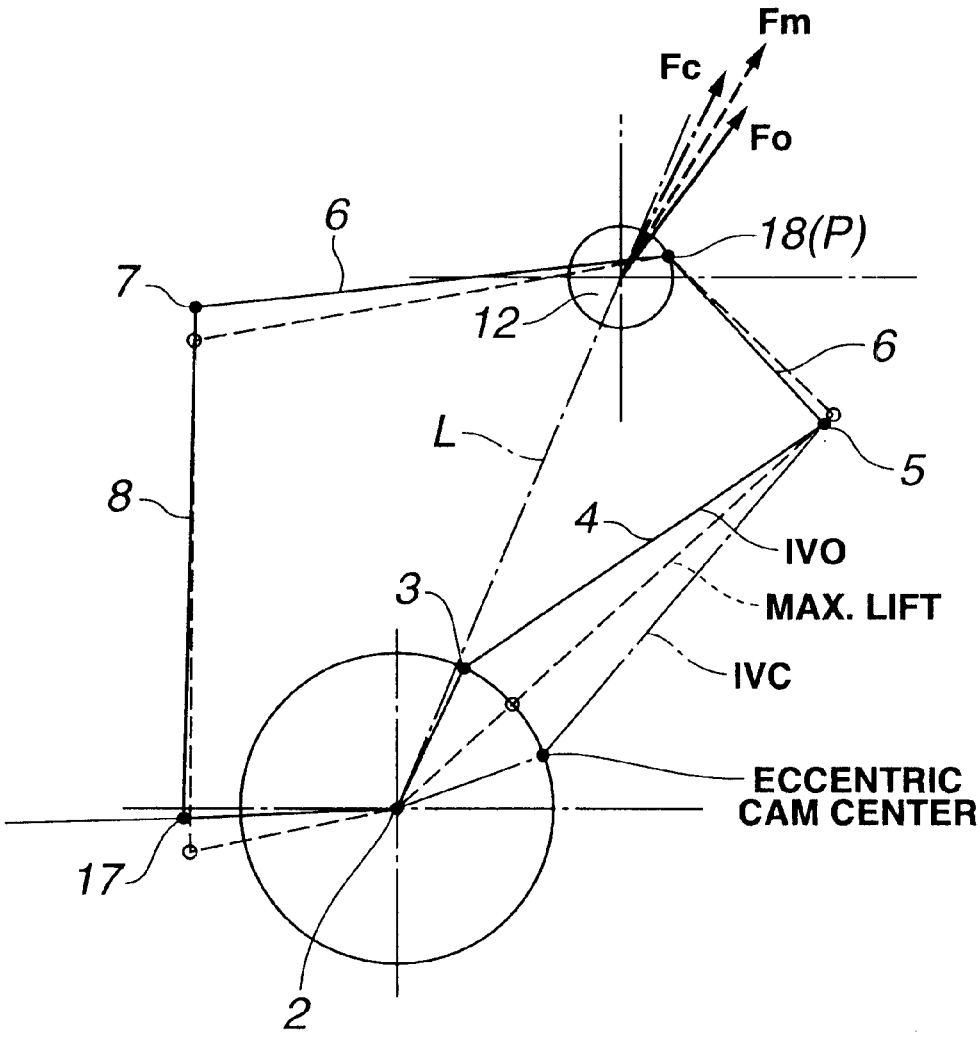
FIG. 7 is a skeleton diagram showing details of directions of loads Fo, Fm, and Fc acting on the control shaft during the intake valve lifted period with the engine at an idle rpm.

Referring now to FIG. 7, there is shown the linkage skeleton diagram for variable lift and working angle control mechanism 1, further detailing the directions of loads Fo, Fc, and Fm each acting on control shaft 12 at the valve-lift characteristic mode used during idling. The solid line shown in FIG. 7 indicates the linkage state and vector of load Fo acting on control shaft 12, created at intake valve open timing IVO. The one-dotted line shown in FIG. 7 indicates the linkage state and vector of load Fc acting on control shaft 12, created at intake valve closure timing IVC. The broken line shown in FIG. 7 indicates the linkage state and vector of load Fm acting on control shaft 12, created when the lift of intake valve 11 reaches the maximum valve lift under the valve-lift characteristic mode used during idling. Load Fo corresponds to a load applied to control shaft 12 just after intake valve open timing IVO. Load Fc corresponds to a load applied to control shaft 12 just before intake valve closure timing IVC. Load Fm corresponds to a load F (see FIG. 6) applied to control shaft 12 when intake valve 11 reaches its maximum valve lift point. In FIG. 7, a point designated by reference sign 3 is the center of first eccentric cam 3, whereas a point designated by reference sign 18 is the center of second eccentric cam 18, that is, the center of oscillating motion of rocker arm 6. As can be appreciated from variations in load applied to control shaft 12, namely Fo, Fm, and Fc shown in FIG. 7, during reciprocating motion of intake valve 11, the magnitude and the sense of load applied to control shaft 12 somewhat vary depending on changes in lift amount of intake valve 11. The change in relative position between the axis of control shaft 12 and the axis of control-shaft position sensor 14 becomes maximum when the maximum valve lift point is reached and thus the applied load F becomes the maximum value (=Fm). Thus, it is more preferable to set the installation angle of base plate 83 such that the direction of load Fm (corresponding to the maximum load (see FIG. 6) applied to control shaft 12 when intake valve 11 reaches the maximum valve lift point, is identical to the direction of the centerline of slit 82. Preferably, in order to adequately attenuate the sensor output error, the direction of the centerline of slit 82 may be included within a predetermined area defined between the direction of the line of action of load Fo having a point of application corresponding to the center of control shaft 12 and the direction of the line of action of load Fc having the same point of application. In other words, the direction of the centerline of slit 82 may be identical to either of directions of the applied loads whose magnitude and sense are varying during the intake valve lifted period at idling. In addition to the above, in variable lift and working angle control mechanism 1 with the linkage structure as shown in FIGS. 1, 6 and 7, the direction of load acting on control shaft 12 during idling tends to be substantially identical to the direction of a line segment L between and including the center of drive shaft 2 and the center of control shaft 12. Therefore, in a more simplified manner, the installation angle of base plate 83 may be set or determined so that the direction of line segment L is identical to the direction of the centerline of slit 82 in the valve-lift characteristic mode used during idling.

Figure 8:
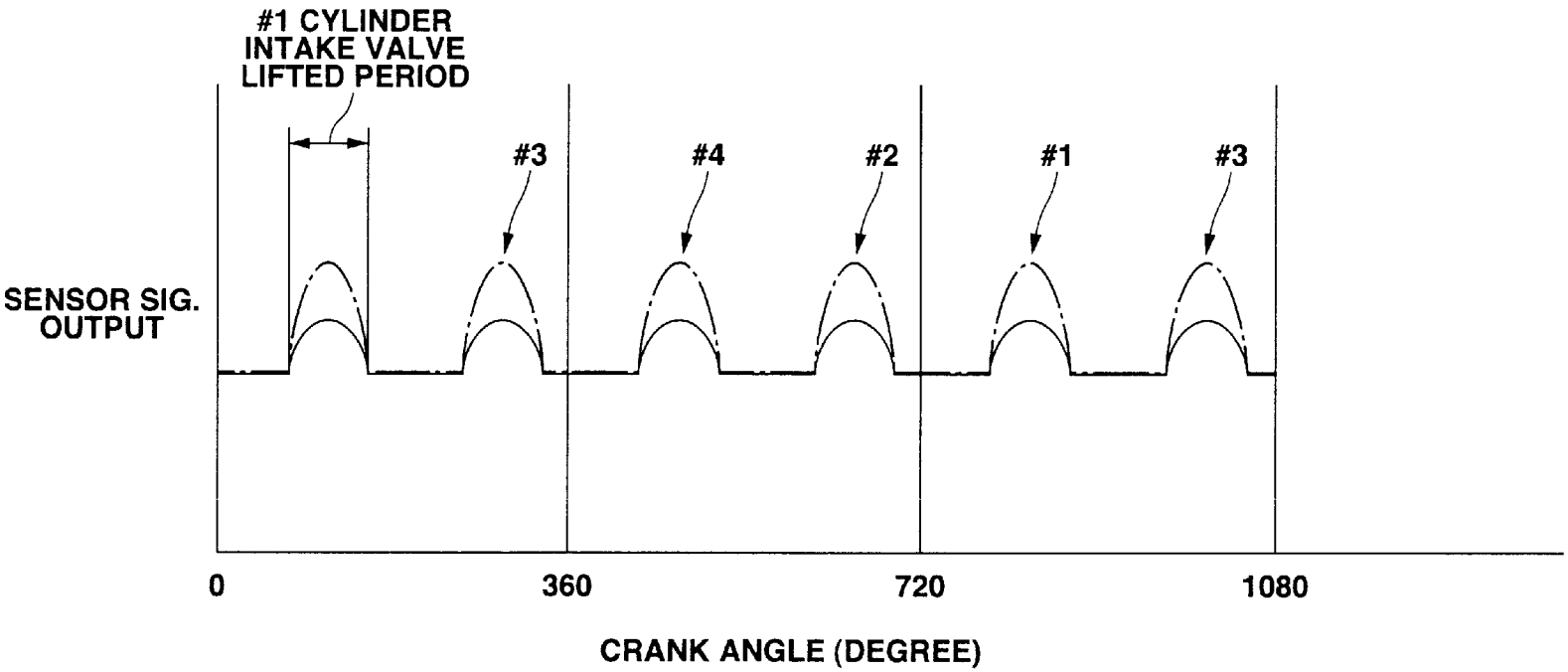
FIG. 8 is a characteristic map showing the relationship between the crank angle and sensor signal output from the control-shaft position sensor during idling.

Referring now to FIG. 8, there is shown the output waveform of the sensor signal from control-shaft position sensor 14 during idling. The signal waveform indicated by the one-dotted line in FIG. 8 shows relatively great sensor output errors created during the intake-valve lifted period of each of #1, #2, #3, and #4 cylinders owing to load applied to control shaft 12 in the conventional variable valve operating system with a control-shaft position sensor simply coupled to a control shaft via a conventional coupling mechanism. On the other hand, the signal waveform indicated by the solid line in FIG. 8 shows relatively small sensor output errors created during the intake-valve lifted period of each of #1, #2, #3, and #4 cylinders owing to load applied to control shaft 12 in the variable valve operating system of the embodiment with control-shaft position sensor 14 coupled to control shaft 12 via an improved pin-slit coupling mechanism (84, 82). Owing to the greatly reduced error, in the system of the embodiment, it is possible to effectively reduce a dead zone for variable lift and working angle control. Thus, it is possible to realize a high-precision variable valve-lift characteristic feedback control.

Figure 9A:
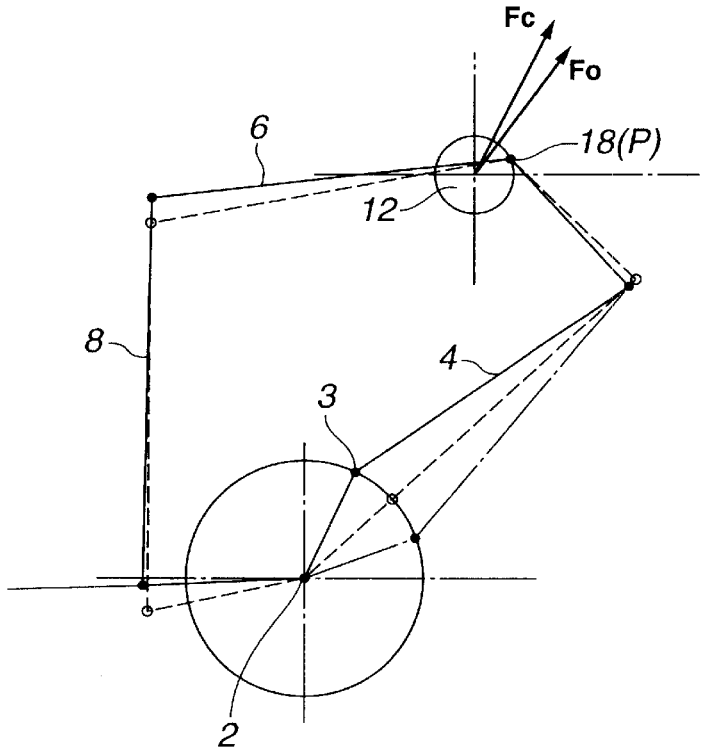
FIG. 9A is an explanatory view showing directions of loads Fo and Fc at an intake valve open timing IVO and an intake valve closure timing IVC, produced when variably controlling the valve lift and working angle of the intake valve to the minimum lift and working angle at idle.
Figure 9B:
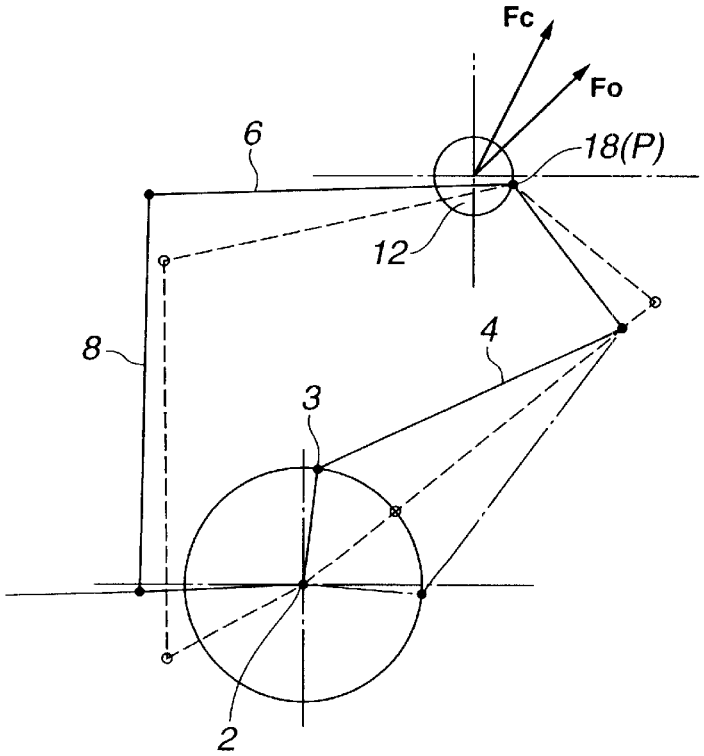
FIG. 9B is an explanatory view showing directions of loads Fo and Fc at IVO and IVC, produced when variably controlling the valve lift and working angle of the intake valve to the maximum lift and working angle at idle.
Figure 10A:
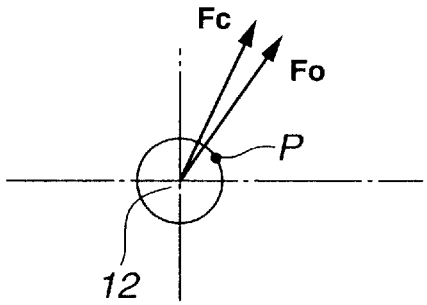
FIG. 10A is an explanatory view showing directions of loads Fo and Fc at the minimum lift and working angle.
Figure 10B:
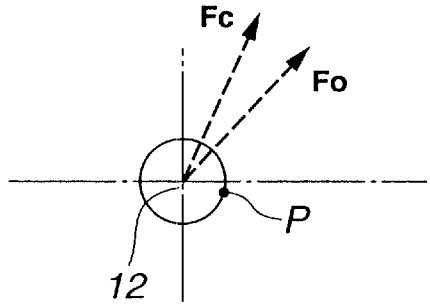
FIG. 10B is an explanatory view showing directions of loads Fo and Fc at the maximum lift and working angle.
Figure 10C:
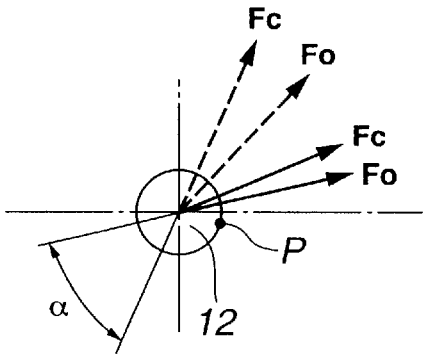
FIG. 10C is an explanatory view showing a wide range of load directions, obtained by combining the directions of loads Fo and Fc at the minimum lift and working angle with the directions of loads Fo and Fc at the maximum lift and working angle.

Referring now to FIGS. 9A and 9B, there are shown the linkage skeleton diagrams, detailing the directions of loads Fo and Fc each acting on control shaft 12 when executing idle speed control by way of the variable valve lift and working angle control, during idling. In the description related to FIGS. 6 and 7, for an easier understanding of the directions of loads acting on control shaft 12 at idle, the valve lift of intake valve 11 is adjusted or fixed to the very small lift amount and additionally the working angle is adjusted or fixed to the very small working angle during engine idling. However, actually the idle speed has to be varied depending on fluctuations in engine loads (for example, on and off operations of an automotive air conditioning system) and thus the idle speed control is generally required. When executing the idle speed control by way of the variable valve lift and working angle control, in order to effectively attenuate or reduce the undesired engine-load fluctuations and to ensure stable idling, the valve lift and working angle are somewhat varied by means of variable valve lift and working angle mechanism 1. FIG. 9A shows the directions of loads Fo and Fc each acting on control shaft 12 at a minimum valve lift and working angle control mode used during an idling period. On the other hand, FIG. 9B shows the directions of loads Fo and Fc each acting on control shaft 12 at a maximum valve lift and working angle control mode used during the idling period. The solid line shown in each of FIGS. 9A and 9B indicates the linkage state created at intake valve open timing IVO and at intake valve closure timing IVC. The broken line shown in each of FIGS. 9A and 9B indicates the linkage state created at the maximum valve lift point of intake valve 11. In FIGS. 9A and 9B, load Fo corresponds to a load applied to control shaft 12 just after intake valve open timing IVO, whereas load Fc corresponds to a load applied to control shaft 12 just before intake valve closure timing IVC. As can be appreciated from comparison between the angular position of the center of second eccentric cam 18 shown in FIG. 9A and the angular position of the center of second eccentric cam 18 shown in FIG. 9B, due to the difference between the minimum valve lift and working angle suited to minimum valve lift and working angle control mode and the maximum valve lift and working angle suited to maximum valve lift and working angle control mode, the angular position of control shaft 12 shown in FIG. 9A is different from that shown in FIG. 9B. As discussed above, when shifting the angular position of control shaft 12 from one of the control-shaft angular position shown in FIG. 9A suited to the minimum valve lift and working angle control mode and the control-shaft angular position shown in FIG. 9B suited to the maximum valve lift and working angle control mode to the other during the idling period, the direction of the centerline of slit 82 also changes. Thus, in determining the installation angle of base plate 83, changes in the direction of the centerline of slit 82, occurring during the idling period, must be considered. FIG. 10A highlights the control shaft portion shown in FIG. 9A and loads Fo and Fc applied thereto, whereas FIG. 10B highlights the control shaft portion shown in FIG. 9B and loads Fo and Fc applied thereto. The directions of loads Fo and Fc are determined based on a reference coordinate system that a directed line extending in the left and right direction of the engine body such as cylinder head 101 is taken as a y-axis and a directed line extending in the vertical direction of the engine body is taken as a z-axis. FIG. 10C shows a wide range of combined load directions, obtained by combining the directions of loads Fo and Fc at the minimum valve lift and working angle control mode shown in FIGS. 9A and 10A with the directions of loads Fo and Fc at the maximum valve lift and working angle control mode shown in FIGS. 9B and 10B. Concretely, the load directions of FIG. 10A are combined with the load directions of FIG. 10B by rotating the vectors Fc and Fo and the center P of second eccentric cam 18 about the center of control shaft 12 in the clockwise direction in such a manner as to match the angular position of control shaft 12 shown in FIG. 10A to the angular position of control shaft 12 shown in FIG. 10B. In other words, on the assumption that control shaft 12 itself is regarded as a reference and the directions of force vectors relative to the center of second eccentric cam 18 (the center of oscillating motion of rocker arm 6) are taken into account, all of the load directions of loads acting on control shaft 12 during idling are shown in FIG. 10C. Therefore, it is desirable to set or determine the installation angle of base plate 83 within a predetermined area defined by an angle a including four load directions, namely a direction of load Fc indicated by the broken line in FIG. 10C, a direction of load Fo indicated by the broken line in FIG. 10C, a direction of load Fc indicated by the solid line in FIG. 10C and a direction of load Fo indicated by the solid line in FIG. 10C.

Figure 11A:
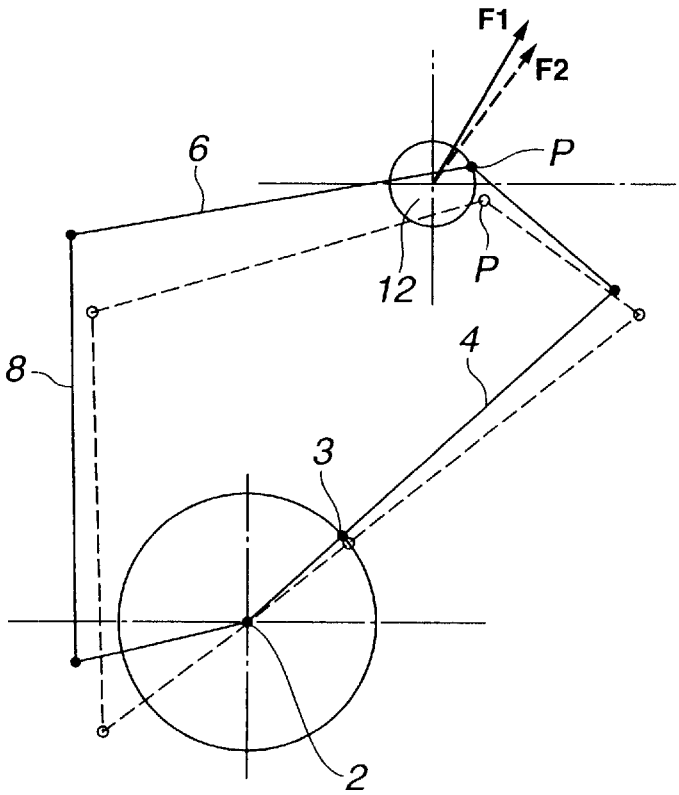
FIG. 11A is a comparative skeleton diagram showing comparison between the direction of load F1 at the minimum lift and working angle and the direction of load F2 at the maximum lift and working angle.
Figure 11B:
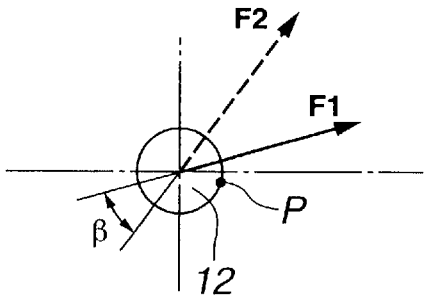
FIG. 11B is an explanatory view showing a wide range of the direction of load, obtained by combining the direction of load F1 at the minimum lift and working angle with the direction of load F2 at the maximum lift and working angle.

Referring now to FIG. 11A, there is shown the linkage skeleton diagram, detailing the directions of loads F1 and F2 each acting on control shaft 12 when executing the idle speed control by way of the variable valve lift and working angle control, during idling. The solid line shown in FIG. 11A indicates the linkage state and vector of load F1 acting on control shaft 12, created when the maximum valve lift point is reached at the minimum valve lift and working angle control mode during the idle speed control. On the other hand, the broken line shown in FIG. 11A indicates the linkage state and vector of load F2 acting on control shaft 12, created when the maximum valve lift point is reached at the maximum valve lift and working angle control mode during the idle speed control. As can be appreciated from comparison between the angular position (see the point P indicated by a black dot) of the center of second eccentric cam 18 shown in FIG. 11A and the angular position (see the point P marked with a small circle indicated by a solid line) of the center of second eccentric cam 18 shown in FIG. 11A, due to the difference between the minimum valve lift and working angle suited to minimum valve lift and working angle control mode and the maximum valve lift and working angle suited to maximum valve lift and working angle control mode, the angular position of control shaft 12 indicated by the black dot in FIG. 11A during application of load F1 is different from that marked with the small circle indicated by the solid line in FIG. 11A during application of load F2. As discussed above, when shifting the angular position of control shaft 12 from one of the two control-shaft angular positions shown in FIG. 11A respectively suited to the minimum valve lift and working angle control mode and the maximum valve lift and working angle control mode to the other during the idling period, the direction of the centerline of slit 82 also changes. Thus, in determining the installation angle of base plate 83, changes in the direction of the centerline of slit 82, occurring during the idling period, must be considered. FIG. 11B shows a wide range of combined load directions, obtained by combining the direction of load F1 at the minimum valve lift and working angle control mode indicated by the solid line in FIG. 11A with the direction of load F2 at the maximum valve lift and working angle control mode indicated by the broken line in FIG. 11A. Concretely, the load direction of force vector F1 indicated by the solid line in FIG. 11A are combined with the load direction of force vector F2 indicated by the broken line in FIG. 11A by rotating the vector F1 and the eccentric-cam center P indicated by the black dot about the center of control shaft 12 in the clockwise direction in such a manner as to match the angular position of control shaft 12 during application of load F1 to the angular position of control shaft 12 during application of load F2. In other words, on the assumption that control shaft 12 itself serves as a reference, all of the load directions of loads F1 and F2 acting on control shaft 12 during idling are shown in FIG. 11B. Therefore, it is desirable to set or determine the installation angle of base plate 83 within a predetermined area defined by an angle β including two load directions, namely a direction of load F1 indicated by the solid line in FIG. 11B, and a direction of load F2 indicated by the broken line in FIG. 11B.

Figure 12:
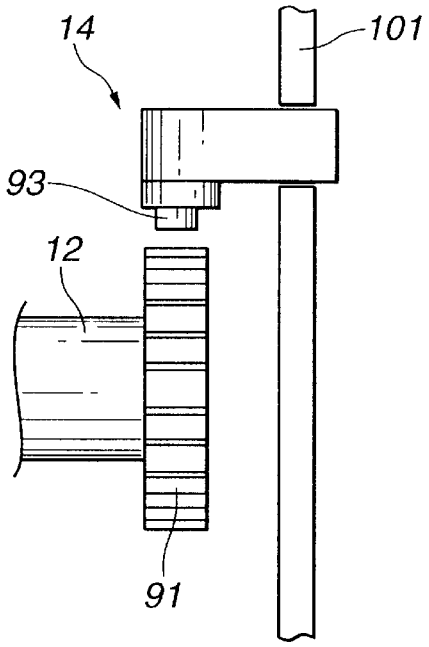
FIG. 12 is a side view illustrating an alternate embodiment of a control-shaft position sensor that is applicable to the variable valve operating system according to the invention.
Figure 13:
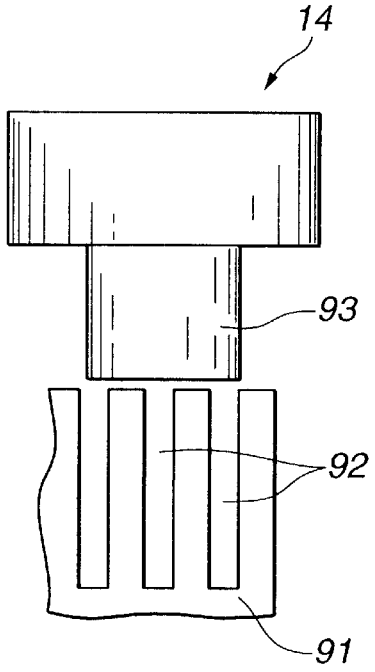
FIG. 13 is a front view of an essential part of the control-shaft position sensor shown in FIG. 12, taken in the axial direction of the control shaft.

Although in the embodiment shown in FIGS. 2 and 3 a rotary potentiometer (a rotary-motion-type variable resistor) is used as control-shaft position sensor 14, in lieu thereof a pulse-generator-type non-contact position sensor shown in FIGS. 12 and 13 may be used as control-shaft position sensor 14.

As shown in FIGS. 12 and 13, the pulse-generator-type non-contact position sensor is comprised of a toothed disc 91 formed on it outer periphery with a plurality of radially-extending slits 92 and an electromagnetic pickup 93. Each of slits 92 has a relatively longer radial length than an air gap defined between the protruding tooth of toothed disc 91 and the tip of a substantially cylindrical sensing portion of electromagnetic pickup 93. Toothed disc 91 is fixedly connected to the shaft end of control shaft 12 so that the center of toothed disc 91 is coaxially arranged with the central axis of control shaft 12. Electromagnetic pickup 93 is fixed or attached to a portion of cylinder head 101 such that pickup 93 is opposite to the outer periphery of toothed disc 91 in the radial direction. In more detail, one pair of two adjacent teeth of toothed disc 91 has a gear tooth pitch different from the other pairs each having the same gear tooth pitch. The different gear tooth pitch means a reference angular position of control shaft 12. The axis of the substantially cylindrical sensing portion of electromagnetic pickup 93 and the axis of control shaft 12 are orthogonal under a particular condition that the engine is stopped. That is, in the stopped state of the engine, the relative-position relationship between control shaft 12 (or toothed disc 91) and electromagnetic pickup 93 is designed so that the substantially cylindrical sensing portion of electromagnetic pickup 93 is in direct alignment with the center of control shaft 12. With the position sensor system shown in FIGS. 12 and 13, assuming that a change in relative position between control shaft 12 and electromagnetic pickup 93 occurs in a direction of a radial line segment interconnecting the center of the substantially cylindrical sensing portion of electromagnetic pickup 93 and the center of control shaft 12 (or the center of toothed disc 91), the magnitude of the sensor output error from electromagnetic pickup 93 becomes a minimum value. In contrast, if the change in relative position between control shaft 12 and electromagnetic pickup 93 occurs in a direction perpendicular to the direction of the radial line interconnecting the center of the substantially cylindrical sensing portion of electromagnetic pickup 93 and the center of control shaft 12, the magnitude of the sensor output error from electromagnetic pickup 93 becomes a maximum value. The pulse-generator-type non-contact position sensor has a directivity for the sensor output error. For the reasons set forth above, in determining the installation position of electromagnetic pickup 93 on the engine cylinder head, only the directions of loads applied to control shaft 12 during idling have to be thoroughly taken into account so as to minimize the sensor output error. However, in the case of the position sensor system shown in FIGS. 12 and 13, even when control shaft 12 is simply rotated by way of the variable valve lift and working angle control during idling, there is no change in relative position between toothed disc 91 and electromagnetic pickup 93. In this case, it is unnecessary to take into account the control state of control shaft 12 that is rotatable about its axis by means of variable valve lift and working angle control mechanism 1 during idling.

As will be recognized from the above, the fundamental concept of the present invention may be applied to the conventional system having a control-shaft position sensor directly coupled to the control shaft end, as disclosed in Japanese Patent Provisional Publication No. 8-260923 (corresponding to U.S. Pat. No. 5,636,603 issued Jun. 10, 1997 to Makoto Nakamura et al.). That is, in the variable valve-lift characteristic control system disclosed in U.S. Pat. No. 5,636,603, it is desirable to set or determine the installation position of the control-shaft position sensor (potentiometer) with respect to the control shaft to minimize the sensor output error, adequately taking into account at least the directions of loads applied to the control shaft during idling.

The entire contents of Japanese Patent Application No. P2001-307031 (filed Oct. 3, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve operating system of an internal combustion engine comprising:

a drive shaft adapted to be rotatably supported on an engine body and to rotate about an axis in synchronism with rotation of a crankshaft of the engine;

a control shaft adapted to be rotatably supported on the engine body;

an actuator driving the control shaft to adjust an angular position of the control shaft;

an intermediate member that rotary motion of the drive shaft is converted into either of rotary motion and oscillating motion of the intermediate member, a center of the motion of the intermediate member with respect to the engine body varying depending on the angular position of the control shaft;

the intermediate member linked to an intake valve of the engine, for lifting the intake valve responsively to the motion of the intermediate member, a valve lift characteristic of the intake valve being varied depending on a change in the center of the motion of the intermediate member;

a position sensor attached to the engine body to generate a sensor signal indicative of the angular position of the control shaft;

the position sensor having a directivity for an error contained in the sensor signal owing to a change in relative position between a center of the control shaft and the position sensor, the error becoming a minimum value in a specified direction of the relative position change; and the specified direction of the relative position change being set to be substantially identical to a direction of a line of action of load acting on the center of the control shaft during idling.

2. The variable valve operating system as claimed in claim 1, wherein:

under a valve lift characteristic used during idling, the specified direction of the relative position change is included in a predetermined area defined between a direction of load acting on the center of the control shaft at an intake valve open timing and a direction of load acting on the center of the control shaft at an intake valve closure timing.

3. The variable valve operating system as claimed in claim 1, wherein:

under a valve lift characteristic used during idling, the specified direction of the relative position change is substantially identical to a direction of load acting on the center of the control shaft at a maximum valve lift point.

4. The variable valve operating system as claimed in claim 1, which further comprises:

a pin-slit coupling mechanism through which the position sensor and the control shaft are coupled to each other, the pin-slit coupling mechanism comprising:

(i) a pin attached to a shaft end of the control shaft so that an axis of the pin is eccentric to an axis of the control shaft; and (ii) a portion defining therein armadillo-elongated slit in engagement with the pin, the portion defining the slit being fixedly connected to the position sensor; and wherein:

a direction of a centerline of the slit is set to be substantially identical to the specified direction of the relative position change, the specified direction of the relative position change varying depending on the angular position of the control shaft.

5. The variable valve operating system as claimed in claim 4, wherein:

the position sensor comprises a rotary potentiometer.

6. The variable valve operating system as claimed in claim 1, wherein:

the position sensor comprises a non-contact sensor having an electromagnetic pickup fixedly connected to the engine body and a toothed disc attached to a shaft end of the control shaft; and a direction of a line segment interconnecting the center of the control shaft and the electromagnetic pickup is set to be identical to the specified direction of the relative position change.

7. The variable valve operating system as claimed in claim 1, wherein:

the control shaft formed integral with an eccentric cam;

the intermediate member comprises a rocker arm supported on an outer periphery of the eccentric cam to permit the oscillating motion of the rocker arm; and the drive shaft having a rockable cam rotatably fitted on an outer periphery of the drive shaft, so that the motion of the rocker arm is transmitted via the rockable cam to the intake valve.

8. A variable valve operating system of an internal combustion engine comprising:

a drive shaft adapted to be rotatably supported on an engine body and to rotate about an axis in synchronism with rotation of a crankshaft of the engine, the drive shaft having a first eccentric cam fixedly connected to an outer periphery of the drive shaft;

a link arm rotatably fitted onto an outer periphery of the first eccentric cam;

a control shaft adapted to be rotatably supported on the engine body, the control shaft formed integral with a second eccentric cam;

an actuator driving the control shaft to adjust an angular position of the control shaft;

a rocker arm rotatably supported on an outer periphery of the second eccentric cam so that the oscillating motion of the rocker arm is created by the link arm;

a rockable cam rotatably fitted on the outer periphery of the drive shaft;

a link member mechanically linking the rocker arm to the rockable cam so that the oscillating motion of the rocker arm is converted into an oscillating motion of the rockable cam and that the intake valve is pushed by the oscillating motion of the rockable cam;

a valve lift and a working angle of the intake valve simultaneously varying by changing an angular position of the second eccentric cam of the control shaft;

a position sensor attached to the engine body to generate a sensor signal indicative of the angular position of the control shaft;

the position sensor having a directivity for an error contained in the sensor signal owing to a change in relative position between a center of the control shaft and the position sensor, the error becoming a minimum value in a specified direction of the relative position change; and the specified direction of the relative position change being set to be substantially identical to a direction of a line segment interconnecting a center of the drive shaft and the center of the control shaft, during idling.

9. An internal combustion engine comprising:

a variable lift and working angle control mechanism that enables both a valve lift and a working angle of an intake valve to be continuously simultaneously varied depending on engine operating conditions; the variable lift and working angle control mechanism comprising:

(a) a drive shaft adapted to be rotatably supported on an engine body and to rotate about an axis in synchronism with rotation of a crankshaft of the engine;

(b) a control shaft adapted to be rotatably supported on the engine body;

(c) an actuator driving the control shaft to adjust an angular position of the control shaft; and (d) an intermediate member through which rotary motion of the drive shaft is converted into either of rotary motion and oscillating motion of the intermediate member, a center of the motion of the intermediate member with respect to the engine body varying depending on the angular position of the control shaft, the intermediate member linked to the intake valve, for lifting the intake valve responsively to the motion of the intermediate member, and a valve lift characteristic including both the valve lift and the working angle of the intake valve being varied depending on a change in the center of the motion of the intermediate member;

sensor means attached to the engine body for generating a sensor signal indicative of the angular position of the control shaft, the sensor means having a directivity for an error contained in the sensor signal owing to a change in relative position between a center of the control shaft and the sensor means, the error becoming a minimum value in a specified direction of the relative position change; and the specified direction of the relative position change being set to be substantially identical to a direction of a line of action of load acting on the center of the control shaft during idling.

10. The variable valve operating system as claimed in claim 9, wherein:

the sensor means comprises a rotary potentiometer.

11. The variable valve operating system as claimed in claim 9, wherein:

the sensor means comprises a non-contact sensor having an electromagnetic pickup fixedly connected to the engine body and a toothed disc attached to a shaft end of the control shaft; and a direction of a line segment interconnecting the center of the control shaft and the electromagnetic pickup is set to be identical to the specified direction of the relative position change.

* * * * *